United States Patent [19]

Bowman

[11] 4,266,340

[45] May 12, 1981

[54] RAZOR HANDLE FOR MOUNTING PIVOTABLE RAZOR BLADE CARTRIDGES

[75] Inventor: Peter Bowman, Sandy Hook, Conn.

[73] Assignee: Warner-Lambert Company, Morris Plains, N.J.

[21] Appl. No.: 47,592

[22] Filed: Jun. 11, 1979

[51] Int. Cl.[3] ..... B26B 21/06; B26B 21/52

[52] U.S. Cl. ..... 30/89; 30/47; 30/50

[58] Field of Search ..... 30/47, 87, 89; 74/470, 74/569

[56] References Cited

U.S. PATENT DOCUMENTS

| | | | |
|---|---|---|---|
| 1,506,091 | 8/1924 | Shultz | 74/470 X |
| 3,308,678 | 3/1967 | Walker | 74/470 |
| 3,975,820 | 8/1976 | Torance | 30/47 |
| 4,018,098 | 4/1977 | Beier | 74/470 |
| 4,083,104 | 4/1978 | Nissen | 30/47 |

*Primary Examiner*—Gary L. Smith

*Attorney, Agent, or Firm*—Jeremiah J. Duggan; R. S. Strickler

[57] ABSTRACT

An improved cam follower subassembly for use in razor handles which mount pivotable razor blade cartridges. The improved cam follower subassembly includes a cam follower member, a spring and a pusher structured to form an interlocking subassembly to facilitate handling and installation into the razor handle housing during assembly. The cam follower member and the pusher each include a stop surface, the stop surfaces being positioned and oriented such that one is moved into limiting engagement with the other under the biasing action of the spring, which spring may be a compression spring disposed about the cam follower member in a captured manner.

7 Claims, 6 Drawing Figures

RAZOR HANDLE FOR MOUNTING PIVOTABLE RAZOR BLADE CARTRIDGES

BACKGROUND OF THE INVENTION

This invention relates generally to the wet shaving art and, more specifically, to razor handles in such art for mounting pivotable razor blade cartridges. More particularly still, the invention relates to improvements in such razor handles, and particularly to the cam follower assembly thereof.

Wet shaving systems employing a disposable razor blade have long been available. More recently, systems employing a reusable handle and a disposable cartridge including cap, blade(s), seat and guard bar became available, the cartridge being mounted in a fixed position relative to the razor handle. More recently still, systems have appeared in which the cartridge was pivotably mounted on the razor handle such that it may generally follow contours of the surface being shaved.

An example of this latter type of system is disclosed in U.S. Pat. No. 4,083,104 issued Apr. 11, 1978, to Nissen et al for RAZOR HANDLE, which is incorporated herein by reference, but only to the extent consistent with the present invention. Such systems will hereinafter be generally referred to as pivoting razor systems, which includes a razor handle for removably mounting a pivotable razor blade cartridge.

In such pivoting razor systems as embodied by the aforementioned patent, the razor handle is provided with opposing pintles or journals which may be actuated by a push-button or the like from an "open" to a "closed" position for engaging the journal bearings of a pivotable blade cartridge. A cam follower in the razor handle is spring-biased into engagement with a cam surface provided on the rear, or underside, of the blade cartridge for exerting a biasing force thereon.

In the aforementioned patent, the journal-actuating push-button, or "pusher", and the spring-biased cam follower member were described as part of an assembly which also included a locking member for releasably holding the journals in the "open" position when the pusher was actuated. That assembly, however, appears to require the assistance of extreme manual dexterity and/or some form of nest or fixture to contain it as an integral unit during assembly of the razor handle at the time of manufacture. More specifically, the cam follower biasing spring acts against the pusher, via the locking member, to urge the cam follower "forward" relative to the pusher and it is only when these several elements are finally placed within the confines of top and bottom housing portions of the handle that the cam follower and pusher assume a normally constant relative position. The requirement of special manual and/or mechanical handling techniques and/or equipment to meet this need for containment of the assembly prior to installation in the handle housing introduces further cost and/or time factors to the manufacturing process.

Accordingly, it is a principal object of the present invention to provide an improved cam follower assembly for a razor handle of the type for pivotably mounting a razor blade cartridge. Included within this object is the provision of a cam follower assembly including a cam follower member, a biasing spring and a pusher member interrelated in a manner facilitating handling and assembly during manufacture of the razor handle.

SUMMARY OF THE INVENTION

In accordance with the present invention there is provided an improved razor handle of the type which mounts a pivotable razor blade cartridge. The invention further and more specifically comprises an improved cam follower subassembly for use in razor handles which mount such pivotable razor blade cartridges. The improved cam follower subassembly includes a cam follower member, a spring and a pusher structured to form an interlocking subassembly to facilitate handling and installation into the razor handle housing during assembly.

The cam follower member and the pusher each include a stop surface, the stop surfaces being positioned and oriented such that one is moved into limiting engagement with the other under the biasing action of the spring. The spring may be a compression spring acting oppositely on the pusher and the cam follower member, and may be disposed about the cam follower member in a captured manner.

The spring-biased limiting engagement between the pusher and the cam follower member serves to retain them in a normally constant, interlocked interrelationship.

DESCRIPTION OF THE PREFERRED EMBODIMENT

Figure 1:
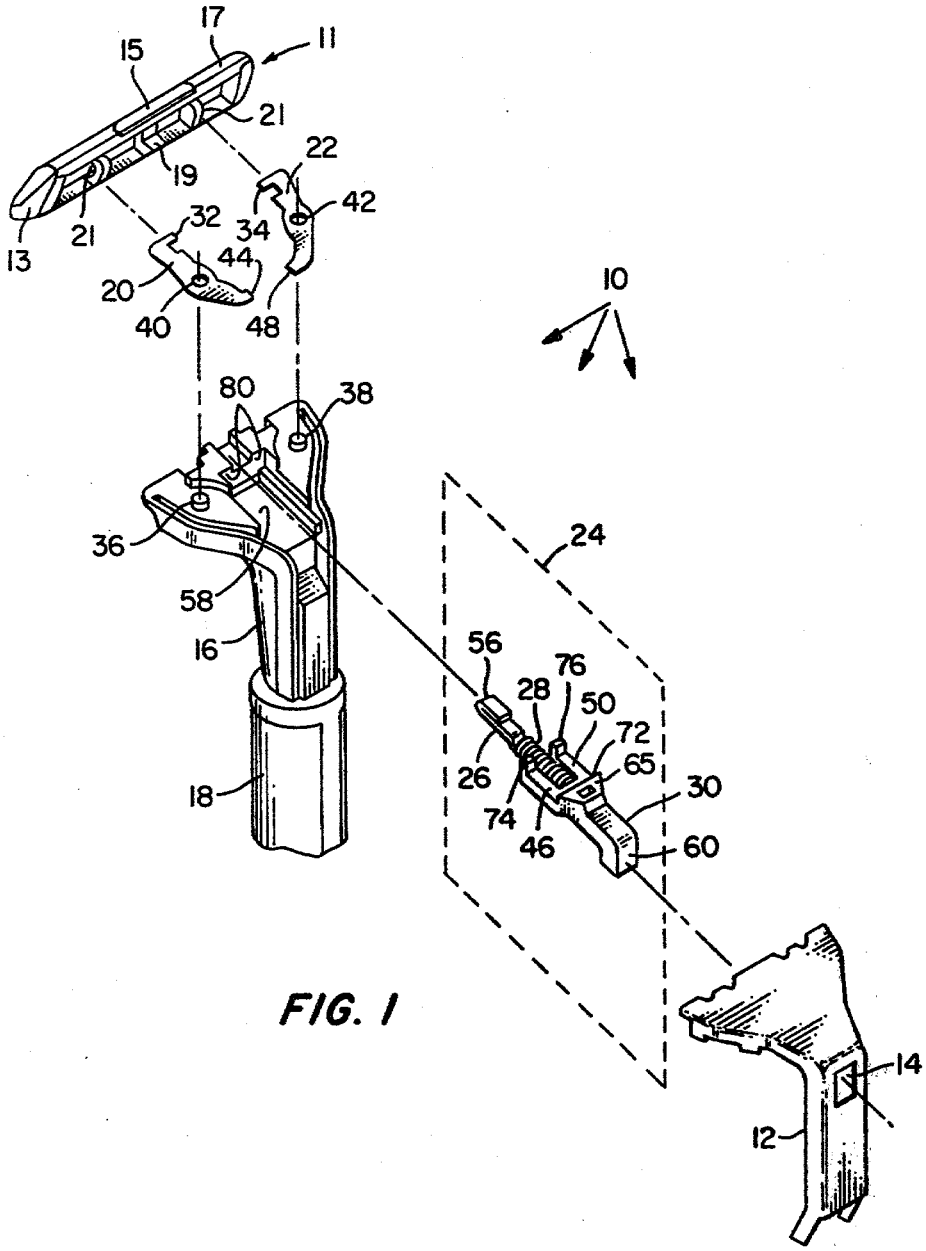
FIG. 1 is an exploded view of a razor handle assembly and blade cartridge, including the improved cam follower subassembly of the handle in accordance with the invention.

Referring to FIG. 1, there is shown an exploded view of a razor handle assembly 10 and a pivotable razor blade assembly 11 for mounting thereon.

Razor blade assembly 11 is of a type illustrated in greater detail in U.S. application Ser. No. 886,711 filed Mar. 15, 1978, by Chen for Safety Razor Cartridge With Clean-Out Device and includes a seat member 13 having a guard member (not visible) along its forward edge, a seat blade (not visible) on the seat, a combined spacer (not shown) and movable clean-out member disposed on the seat blade and having actuating tab 15, a cap blade (not shown) on the spacer, and a cap member 17 on the cap blade and bonded to the seat member 13 in a known manner. The seat member includes a cam surface 19 and a pair of spaced journal bearings 21 on the underside thereof as described in the aforementioned U.S. Pat. No. 4,083,104.

The handle assembly 10 includes a metal upper handle housing portion 12 with an aperture 14 therein, a plastic lower handle housing portion 16 interference-fitted into a cylindrical handle shank 18, the two housing portions 12 and 16 cooperating to provide a housing for pivot arms 20 and 22 and a cam follower subassembly 24 comprising a substantially rigid cam follower member 26, a biasing spring 28, and a pusher member 30. The pivot arms 20 and 22 are provided with opposing pintles or journals 32 and 34 and are arranged to project from the handle assembly 10. Pivot arms 20 and 22 are pivotably mounted on journals 36 and 38 respectively on a top portion of the lower handle housing 16 and which extend through apertures 40 and 42 in the respective arms. The pivot arms 20 and 22 are disposed, in the main, between the housing formed by handle housing portions 12 and 16 and are generally free to pivotally move about the journals 36 and 38.

The pusher member 30, the cam follower member 26 and the bias spring 28 are arranged in an interlocking manner in accordance with the invention to form an integral cam follower subassembly 24 for pivotally moving the arms 20 and 22 about their journals 36 and 38 when an end 44 of the arm 20 is disposed over a pusher surface 46 and an end 48 of the arm 22 is disposed over a pusher surface 50. The pusher surfaces 46 and 50 are downwardly recessed to define slots in which the pivot arm ends 44 and 48 are generally captured when the razor handle 10 is assembled.

Figure 2:
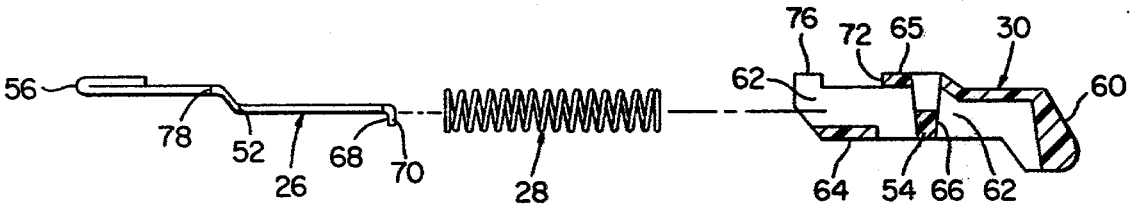
FIG. 2 is an exploded view of the cam follower subassembly.
Figure 3:
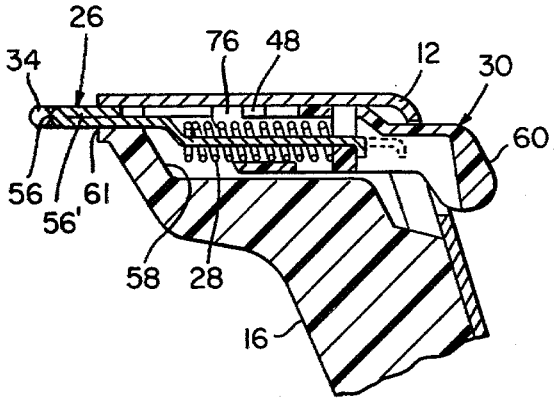
FIGS. 3 and 4 are center-line, cross-sectional views of a side elevation of the razor handle assembly of FIG. 1, with the pusher normaly relaxed and actuated respectively.
Figure 4:
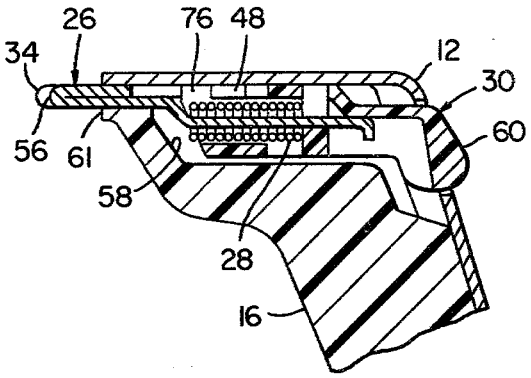

Referring to FIGS. 2–4, the spring 28 is coupled between a rearward facing stop surface or tab 52 on cam follower member 26 and the forward facing surface of a transverse stop rib 54 within pusher member 30 to provide a desired bias force to urge the forward end 56 of cam follower 26 against the cam surface 19 on razor blade assembly 11 when mounted on handle assembly, for exerting a biasing force thereon.

Referring to FIGS. 3 and 4, there is shown a cross-section of a side elevation view taken along a median of the razor handle assembly 10. The cam follower subassembly 24 is disposed between a recessed portion 58 of the handle lower housing portion 16 and the upper housing portion 12. The spring member 28 is compressed between the tab 52 and the pusher stop rib 54 to urge the pusher member 30 rearwardly to cause the pusher end 60 to project from the aperture 14 in the housing portion 12 and the forward end 56 of cam follower 26 to project from an opening 61 formed between the handle housing portions 12 and 16.

Referring to the Figures in greater detail, and particularly to FIGS. 3 and 4, the cam follower subassembly 24 will be considered in greater detail in accordance with the invention. The pusher member 30 is an elongated molded plastic member having an elongated recess or cavity 62 extending from the front end rearwardly to near the rear end 60. The pusher cavity 62 is circular in cross-section from the front of the pusher 30 to the rear side of the stop rib 54, and is rectangular and opens downward thereafter. A lower support web 64 transversely spans the pusher 30 beneath its forward end for upwardly supporting the cam follower 26 and spring 28. An upper support web 65 transversely spans pusher 30 at its midsection above cam follower 26 and spring 28 to restrict their upward movement. The stop rib 54 transversely spans the pusher 30 rearwardly of the web 64 and extends upwardly somewhat beyond the upper surface of that web thereby also providing vertical support to cam follower 26. The rear surface 66 of stop rib 54 defines a limit or stop for engaging a stop surface 68 defined by the forward face of stop tab 70 extending downwardly from the cam follower 26.

The spring 28 is a helical compression spring having closed loops at each end and which extends from stop tabs 52 to about or just beyond the stop tab 70 on cam follower 26 when mounted thereon. The recess 62 in the forward portion of pusher 30 is of sufficient diameter to receive the cam follower 26 with the spring mounted thereon.

To assemble the cam follower subassembly 24 from the cam follower 26, spring 28 and pusher 30, it is only necessary to install the spring over the rear portion of the cam follower, then move those combined elements rearwardly into the recess 62 in pusher 30. Because the stop rib 54 extends up into the recess 62, it is necessary to rotate the cam follower 26 about its longitudinal axis such that its stop tab 70 extends to one side or the other, thus clearing the tab 70. By further rearward insertion of cam follower 26 and 90° rotation in the appropriate direction, the stop tab 70 is then positioned behind stop rib 54 in the depending orientation illustrated in FIG. 3. Further, the height of rib 54 constricts recess 62 sufficiently to create a stop against which the rear end of spring 28 bears. In this way, the spring is forced into compression between rib 54 and cam follower tab 52, thereby urging the cam follower 26 forward relative to pusher 30. However, the forward displacement of cam follower 26 is limited by the engagement of the surface 68 of cam follower stop tab 70 with the rear face of pusher stop rib 54, thereby interlocking the several elements which comprise cam follower subassembly 24. The pusher support web 64 supports the underside of spring 28 so as to further assure the positioning and retention of the cam follower within the pusher.

By forming complementary stop surfaces on the pusher and cam follower, and spring-biasing the two into mutual opposing engagement, it is thus possible to provide the interlocked subassembly which is then relatively easily handled, either manually or automatically, during the remaining assembly of the razor handle, without requiring special nests or fixtures.

Figure 5:
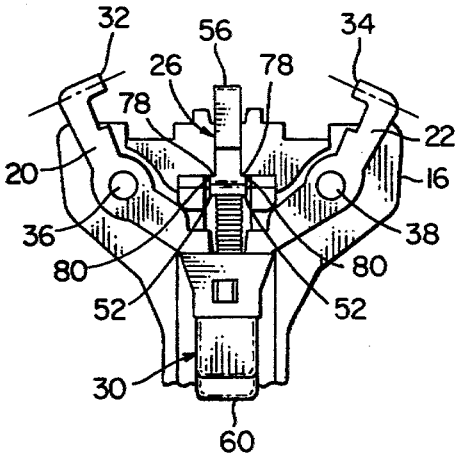
FIGS. 5 and 6 are top views of the razor handle assembly shown in FIG. 1, with the top housing removed and with the pusher actuated and normally relaxed respectively.

To attach a blade assembly 11 to the razor handle 10, a pusher member front surface 72 is urged forward against the arm ends 44 and 48 in response to manual pressure or force applied against the pusher rear end 60 (FIG. 4). The forward movement of the pusher member 30 causes the pivotal movement of the arms 20 and 22 about the journals 36 and 38 in response to the surface 72 acting against the arm ends 44 and 42. The arms 20 and 22 are moved into an open position (FIG. 5) in which the longitudinal axes of the respective journals 32 and 34 are no longer parallel.

The razor handle 10 may then be moved relatively into engagement with a razor blade assembly 11 such that the cam follower end 56 presses against the blade assembly's cam surface 19, and the journals 32 and 34 are closely adjacent and generally aligned with the journal bearings 21.

Figure 6:
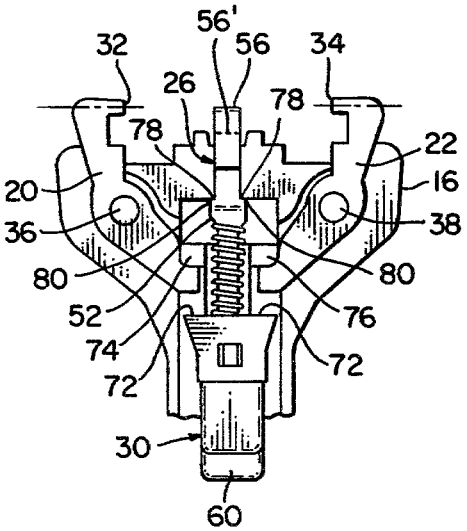

To close the arms 20 and 22, it is only necessary to release the manual force being applied to the pusher rear end 60, whereupon the bias spring 28 returns the pusher 30 rearward to its normal relaxed position illustrated in FIGS. 3 and 6. In moving rearward, the upstanding tabs 74 and 76 at the forward ends of surfaces 46 and 50 on pusher 30 engage the arm ends 44 and 48 and pivot the arms 20 and 22 to the closed position, with the journals 32 and 34 extending into journal bearings 21 of blade assembly 11, thereby to mount the pivotable blade assembly on the handle assembly 10.

The cam follower 26 is urged forward such that forward facing stop tabs 78 thereon are normally in limiting engagement with rearward facing stop surfaces 80 on the lower housing portion 16 near the forward end of its recessed portion 58. However, with a blade assembly 11 mounted on the handle assembly 10, the cam follower 26 is displaced relatively rearward by the cam surface 19, particularly as the blade assembly pivots about handle journals 32 and 34. This rearward displacement of cam follower 26 is illustrated by dotted lines in FIGS. 3 and 6, with the forward end of the cam follower being designated 56'. The forward bias of spring 28 on the cam follower 26, and its end 56, serves to restore the blade assembly 11 to its neutral position.

The present embodiment is to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. In a razor handle comprising a housing having first and second pivot means, first and second arms mounted on said first and second pivot means respectively and adapted to engage first and second portions respectively of a razor blade assembly, cam follower means disposed within said housing and comprising a substantially rigid spring-biased member having a forward end projecting from said housing and being reciprocably movable in response to a force applied thereto by pivotal movement of said razor blade assembly on said first and second arms, a pusher means disposed on said housing and operatively connected to said first and second arms, said pusher means, upon actuation thereof by an operator, effecting movement of said first and second arms each away from the other upon said first and second respective pivot means whereby to release said blade assembly, the improvement comprising said cam follower member including a first stop surface extending transversely of said direction of reciprocation and facing substantially in the direction of said cam follower member forward end and a second stop surface extending transversely of said direction of reciprocation and facing substantially opposite to the direction of said cam follower means forward end;

said pusher means including a recess for slidably receiving a rear portion of said reciprocable cam follower member and a stop surface extending transversely of said direction of cam follower member reciprocation and positioned to engage said cam follower member first stop surface; and said biasing spring comprising compression spring means encircling a portion of said cam follower member, said spring acting in compression oppositely on said cam follower member second stop surface and said pusher means to bias said cam follower member forward relative to said pusher means such that said cam follower member first stop surface and said pusher means stop surface are normally in limiting engagement when no blade assembly is in said razor.

2. In a razor handle for mounting a pivotable razor blade cartridge, said handle including a pair of opposed movable arms for pivotably mounting a said cartridge, a pusher means for moving said arms from a blade-mounting to a blade-releasing position, cam follower means comprising a substantially rigid spring-biased member having forward and rearward ends, said forward end projecting from said handle and said cam follower means being reciprocably movable in the direction of said forward and rearward ends in response to a force applied thereto by pivotal movement of a said cartridge mounted on said arms, said cam follower member being biased in the forward direction by spring means acting effectively between said cam follower member and said pusher means, the improvement wherein:

said cam follower member includes a first stop surface extending transversely of said direction of reciprocation and facing substantially in the direction of said cam follower member forward end;

said pusher means includes a recess for slidably receiving a rear portion of said reciprocable cam follower member and a second stop surface extending transversely of said direction of cam follower member reciprocation and positioned to engage said cam follower member first stop surface; and said biasing spring comprises cylindrical spring means encircling a portion of said cam follower member, said spring means acting relatively between said cam follower member and said pusher means to bias said cam follower member forward relative to said pusher means such that said cam follower member first stop surface and said pusher means second stop surface are normally in limiting engagement when no cartridge is in said razor.

3. An improved cam follower assembly for use in a razor handle for mounting pivotable razor blade cartridges, said handle including a pair of opposed movable arms for pivotably mounting a said cartridge and a cam follower assembly including a pusher means for moving said arms from a blade-mounting to a blade-releasing position and a cam follower means comprising a substantially rigid spring-biased member having forward and rearward ends, said forward end projecting from said handle and being reciprocably movable in the direction of said forward and rearward ends in response to a force applied thereto by pivotal movement of a said cartridge mounted on said arms, said cam follower member being biased in the forward direction by spring means acting between said cam follower member and said pusher means, the improvement wherein:

said cam follower member includes a first stop surface extending transversely of said direction of reciprocation and facing substantially in the direction of said cam follower member forward end;

said pusher means includes a recess for slidably receiving a rear portion of said reciprocable cam follower member and a second stop surface extending transversely of said direction of cam follower member reciprocation and positioned to engage said cam follower member first stop surface; and said biasing spring comprises cylindrical spring means encircling a portion of said cam follower member, said spring means acting between said cam follower member and said pusher means to bias said cam follower member forward relative to said pusher means such that said cam follower member first stop surface and said pusher means second stop surface are in mutually opposed limiting engagement prior to installation in said razor handle thereby to operatively interlock said cam follower means, pusher means and spring into an integral subassembly to facilitate introduction thereof to said razor handle during assembly.

4. The razor handle of claim 1 wherein said pusher means recess is at least partly defined by support means portions thereof extending transversely of the direction of cam follower member reciprocation both above and below said cam follower member and said spring to retain them within said recess.

5. The razor handle of claim 2 wherein said pusher means recess is at least partly defined by support means portions thereof extending transversely of the direction of cam follower member reciprocation both above and below said cam follower member and said spring to retain them within said recess.

6. The cam follower assembly of claim 3 wherein said pusher means recess is at least partly defined by support means portions thereof extending transversely of the direction of cam follower member reciprocation both above and below said cam follower member and said spring to retain them within said recess.

7. The cam follower assembly of claim 6 wherein said cam follower member stop surface is near the rear end of said cam follower member, said pusher means second stop surface is a rearward facing surface of a transversely extending support rib, and said biasing spring is a compression spring positioned entirely forward of and acting in engagement against said pusher means support rib.

* * * * *